US007083512B2

(12) United States Patent
Auguste, Jr. et al.

(10) Patent No.: US 7,083,512 B2
(45) Date of Patent: Aug. 1, 2006

(54) COIN AND TOKEN ORGANIZING, HOLDING AND DISPENSING APPARATUS

(76) Inventors: Marc Auguste, Jr., 245 Lakeshore Drive Unit 102, Toronto, Ontario (CA) M8V 2A8; Marc B. Auguste, Sr., 1283 Johnson St West, Thetford Mines, Quebec (CA) G6G 5W7; Jacqueline A Johnson-Auguste, 245 Lakeshore Drive Unit 102, Toronto, Ontario (CA) K8V 2A8

( * ) Notice: Subject to any disclaimer, the term of this patent is extended or adjusted under 35 U.S.C. 154(b) by 451 days.

(21) Appl. No.: 10/193,905

(22) Filed: Oct. 7, 2002

(65) Prior Publication Data

US 2004/0198211 A1 Oct. 7, 2004

Related U.S. Application Data

(60) Provisional application No. 60/305,845, filed on Jul. 17, 2001.

(30) Foreign Application Priority Data

Jul. 15, 2002 (CA) ..... 2392678

(51) Int. Cl.
*G07D 9/06* (2006.01)

(52) U.S. Cl. ..... 453/61; 453/39; 453/53; 453/54; 232/64; 206/0.8; 206/0.84; 150/136; 150/150; 221/92; 221/279; 221/303; 221/185

(58) Field of Classification Search ..... 453/39, 453/43, 44–47, 50–54, 61–63; 206/0.8, 0.81, 206/0.815, 83, 84; 221/92, 279, 303, 185; 446/8–13

See application file for complete search history.

(56) References Cited

U.S. PATENT DOCUMENTS 2,896,892 A * 7/1959 Berardinelli ..... 248/309.1

(Continued)

*Primary Examiner*—Gene O. Crawford
*Assistant Examiner*—Jeffrey A. Shapiro
(74) *Attorney, Agent, or Firm*—J. Gordon Thomson

(57) ABSTRACT

An improved coin and token organizing, holding and dispensing apparatus comprises a lower housing for organizing, holding and dispensing a pre-determined number of coins and tokens of varying sizes and denominations. The lower housing has a substantially rectangular shape having a taper along its length so that the apparatus fits conveniently in pocket or purse and is comfortable to hold. The apparatus is well suited for visually and physically impaired individuals as it permits the ready identification and handling of coins based on the tapered shape of the apparatus and the ability to distinguish by touch one coin from another. The lower housing has a substantially open top surface, a closed flat bottom surface; and, closed vertical sides. Within the lower housing is a plurality of linearly disposed cylindrical wells. Each well is adapted to receive a coin or token of a predetermined size. To partially enclose each well of the lower housing so that the coins are retained in their respective wells, while at the same time permitting the charging and discharging of the holder, an upper plate is mounted on the top open surface of the lower housing. Means are provided to facilitate the smooth and easy charging of and discharging of coins from each well. The lower housing and upper plate are manufactured as unitary pieces from light-weight thermoplastic material having desired resiliency and duration while permitting various advertising material to be fixed to them, for example, adhesively.

1 Claim, 4 Drawing Sheets

U.S. PATENT DOCUMENTS

| | | | | | |
|---|---|---|---|---|---|
| 3,242,930 | A | * | 3/1966 | Wilner | 453/48 |
| 3,731,695 | A | | 5/1973 | Meijer | |
| 4,099,532 | A | | 7/1978 | Mascherin | |
| D252,775 | S | * | 8/1979 | Stoffel | D99/34 |
| 4,540,008 | A | * | 9/1985 | Murphy | 453/18 |
| 5,024,629 | A | * | 6/1991 | Murray | 453/54 |
| 5,377,828 | A | * | 1/1995 | Jaroshewich | 206/315.1 |
| 5,492,504 | A | * | 2/1996 | Wolters | 453/54 |
| 5,499,710 | A | | 3/1996 | Hoffman | |
| 5,833,054 | A | * | 11/1998 | Graves | 206/38.1 |
| 5,884,513 | A | | 3/1999 | Norris | |
| 6,302,777 | B1 | * | 10/2001 | Zoldan | 453/54 |
| D455,245 | S | * | 4/2002 | Bakker | D99/334 |
| 2002/0195354 | A1 | * | 12/2002 | Davis, Jr. | 206/0.84 |

* cited by examiner

COIN AND TOKEN ORGANIZING, HOLDING AND DISPENSING APPARATUS

CROSS-REFERENCE TO RELATED APPLICATIONS

This application is entitled to the benefit of Provisional Patent Application Ser. No. 60/305,845 filed Jul. 17, 2001.

FIELD OF THE INVENTION

This invention relates to a coin and token organizing, holding and dispensing apparatus, and more specifically, to an improved coin and token holding and dispensing apparatus that is lightweight, adapted to organize, hold and dispense coins of varying sizes and denominations, additionally holds public transit tokens, and fits conveniently in a pocket or purse.

BACKGROUND OF THE INVENTION

Many countries are increasing the number of coins in circulation. Coins have better durability and therefore are less expensive than paper notes to maintain in circulation. For example, in addition to circulating pennies, dimes, nickels and quarters Canada has a one-dollar and two-dollar coin. The United States has recently introduced a one-dollar coin and the European Union utilizes Euro coins in various denominations. Furthermore, many large public transit systems rely upon tokens rather than currency as payment. This plethora of coins in circulation means that the pockets and purses of the average consumer are often filled with coins. Modern billfolds and wallets are not large enough to hold and dispense coins in an organized and convenient fashion. Furthermore, people who are visually impaired or who have other physical impairments have difficulty handling and identifying coins. A number of coin holders have been proposed to overcome this problem. For example, U.S. Pat. No. 5,884,513 issued to Norris on Mar. 23, 1999 discloses a Combination Coin and Key Holder. This coin holder can only hold two coins and therefore is totally unsuited to situations where several coins of varying sizes and denominations must be held. Similarly, U.S. Pat. No. 5,499,710 issued to Hoffman on Mar. 19, 1996 discloses a Portable Coin Holder and Dispenser that is limited in the number and size of coins that it can carry. U.S. Pat. No. 4,099,532 issued to Mascherin on Jul. 11, 1978 teaches a Coin Holder Having Rib Retained Closure that is able to hold only a single size of coin at one time. U.S. Pat. No. 3,371,695 issued to Meijer on May 8, 1973 for a Coin Holder and Coin Dispenser discloses a device that is disadvantaged by the limited number of different denomination coins that it can hold. Furthermore, the circular shape of Meijer's invention means that it must be significantly increased in diameter to hold a full set of denominations of modern coins. This would result in a device that is too large to fit comfortably in hand or in a pocket. Additionally, since Meijer contains a number of spaces or voids in the various pieces of the device to save weight, the mold for making such a device would have to be intricate and therefore expensive. Finally, Meijer relies upon screw fasteners that complicates assembly and leads to ease of unwanted disassembly. Therefore, there continues to be a need for a lightweight apparatus that is able to conveniently organize, hold and dispense a plurality of coins and tokens of varying sizes and denominations, that is inexpensive to manufacture, easy to use and shaped to fit conveniently and comfortably in hand, pocket and purse.

OBJECTS OF THE INVENTION

An object of the present invention is to provide an improved coin and token organizing, holding and dispensing apparatus that overcomes the problems cited above.

It is an object of the present invention to provide an improved coin and token organizing, holding and dispensing apparatus that is adapted to organize, hold and dispense coins of varying sizes and denominations, additionally holds public transit tokens, and fits conveniently in pocket or purse.

It is a further object of the invention to provide a convenient coin and token holding, dispensing and organizing apparatus well suited for use by visually and physically impaired individuals.

A further object of the present invention is to provide an improved coin and token organizing, holding and dispensing apparatus that can hold a plurality of coins of different denominations and nationalities.

Yet another object of the present invention is to provide an improved coin and token organizing, holding and dispensing apparatus that can be easily manufactured using lightweight molded thermoplastic parts.

Another object of the present invention is to provide an improved coin and token organizing, holding and dispensing apparatus that is shaped to fit conveniently and comfortably in hand, pocket and purse.

Still another object of the present invention is to provide an improved coin and token organizing, holding and dispensing apparatus that is manufactured from lightweight material and does not significantly add to the weight of coins in a purse or pocket.

Further objects and advantages of my invention will become apparent from a consideration of the following, summary, drawings and detailed description.

SUMMARY OF THE INVENTION

In accordance with the present invention an improved coin and token organizing, holding and dispensing apparatus comprises a lower housing for organizing, holding and dispensing a pre-determined number of coins and tokens of varying sizes and denominations. The lower housing has a substantially rectangular shape having a taper along its length so that the apparatus fits conveniently in pocket or purse and is comfortable to hold. The lower housing has a substantially open top surface, a closed flat bottom surface; and, closed vertical sides. The tapered shape and substantially open surface permits ready identification of coins by visually impaired individuals. Within the lower housing is a plurality of linearly disposed cylindrical wells. Each well is adapted to receive a coin or token of a predetermined size. To partially enclose each well of the lower housing so that the coins are retained in their respective wells, while at the same time permitting the charging and discharging of the holder, an upper plate is mounted on the top open surface of the lower housing. Means are provided to facilitate the smooth and easy charging of and discharging of coins from each well. The lower housing and upper plate are manufactured as unitary pieces from lightweight thermoplastic material having desired resiliency and duration while permitting various advertising material to be fixed to them, for example, adhesively.

DETAILED DESCRIPTION

Figure 1:
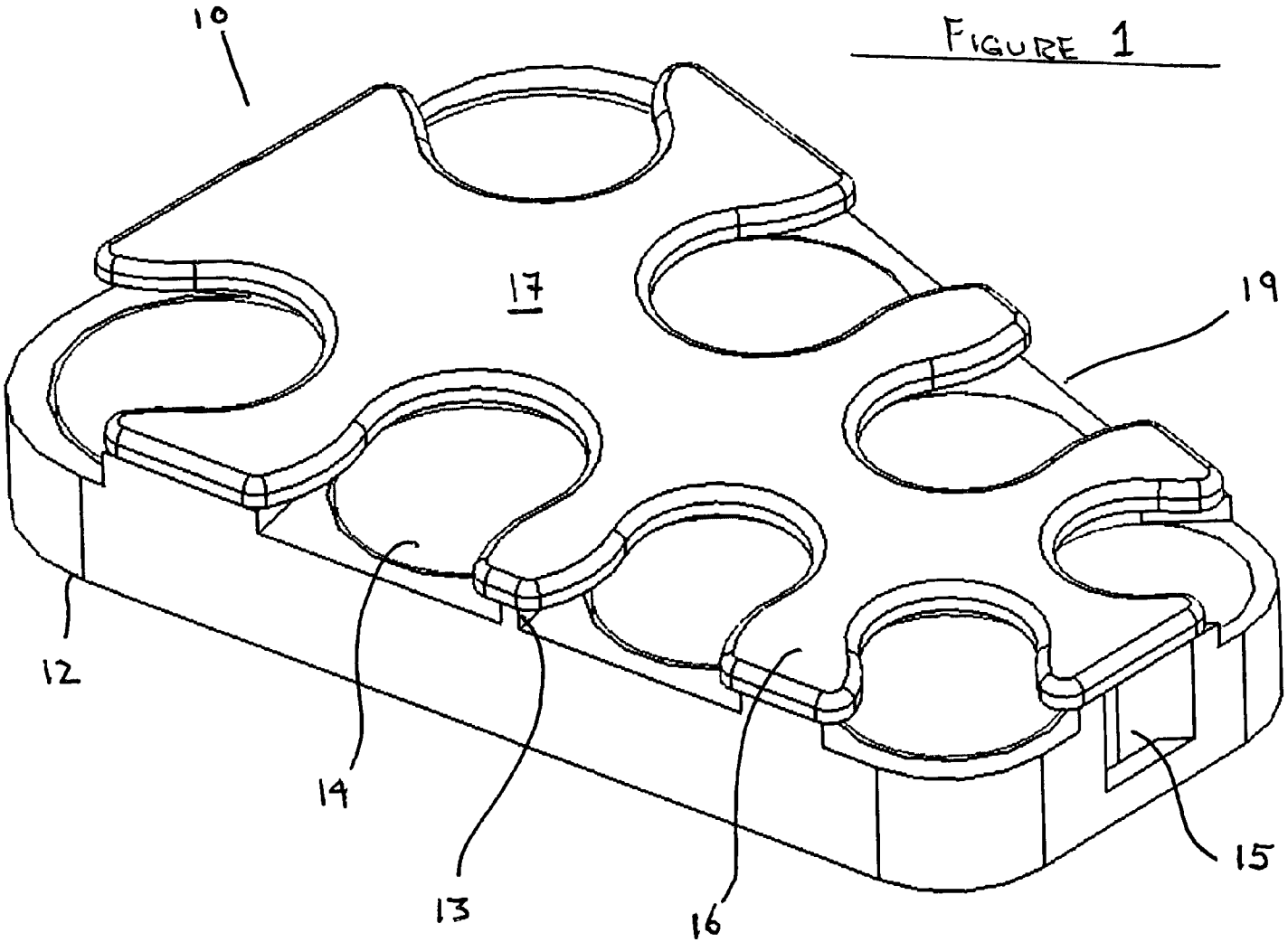
FIG. 1 illustrates in perspective view one embodiment of the invention.

One embodiment of my invention is shown in FIG. 1 and illustrates a top perspective view. In my invention there is provided a coin and token organizing, holding and dispensing apparatus (10) comprising a lower housing (12) for organizing and holding a plurality of coins of varying sizes and denominations. For example, the embodiment shown has eight (8) wells (14) for holding Euros in 2, 1, 0.5, 0.2, 0.1, 0.05, 0.02 and 0.01 Euro denominations. A similar device for Canadian coins might have six (6) wells for $2, $1, $0.25, $0.10, $0.05 and $0.01 coins. A similar device for American coins might have wells for $1, $0.25, $0.10, $0.05 and $0.01 coins plus tokens or, alternatively, two wells for $1 coins. Whatever the currency, a plurality of linearly spaced circular wells (14) is adapted to hold a predetermined number of coins of a particular denomination in the lower housing (12). A flat top plate (16) is placed over the lower housing to maintain the coins in their respective wells (14) while permitting the smooth and easy charging and discharging of coins. My invention has an elongated trapezoidal shape having a wide end and a narrow end with a taper from the wells holding the larger denomination coins at the wide end towards at the smaller denomination coin wells at the narrow end. This not only permits the hold to accommodate larger coins but permits my invention to fit comfortably in pocket, purse or hand. The taper permits visually impaired individuals to be able to identify one end of the invention from the other and therefore readily locate large denomination coins (located at the wide end) and smaller denomination coins (located at the narrow end). As well, since the top surface and sides of the coins are exposed to the touch of visually impaired individuals, the identification of individual coins can be made by feeling their shape and texture. Finally, the casing of the apparatus is well adapted for placing identifying brail to distinguish one denomination from another.

To increase the commercial attractiveness of my invention, the upper plate (16) has sufficient surface space (17) for promotional advertising and logos of various entities. This advertising or logos may take the form of an adhesive sticker or may be engraved into the top surface of the upper plate.

Still referring to FIG. 1, are notches (15) in either end of the apparatus so that a key holding device, such as a key ring, may be attached to it. Spacers (13) molded into bottom housing (12) ensure that mouth (19) is sufficiently dimensioned to permit it to receive coins of varying thickness. Circular wells (14) extend from the bottom of the top plate (16) to the top surface of the bottom of the housing (12). The thickness of the apparatus remains substantially constant from one end to the other.

Figure 2:
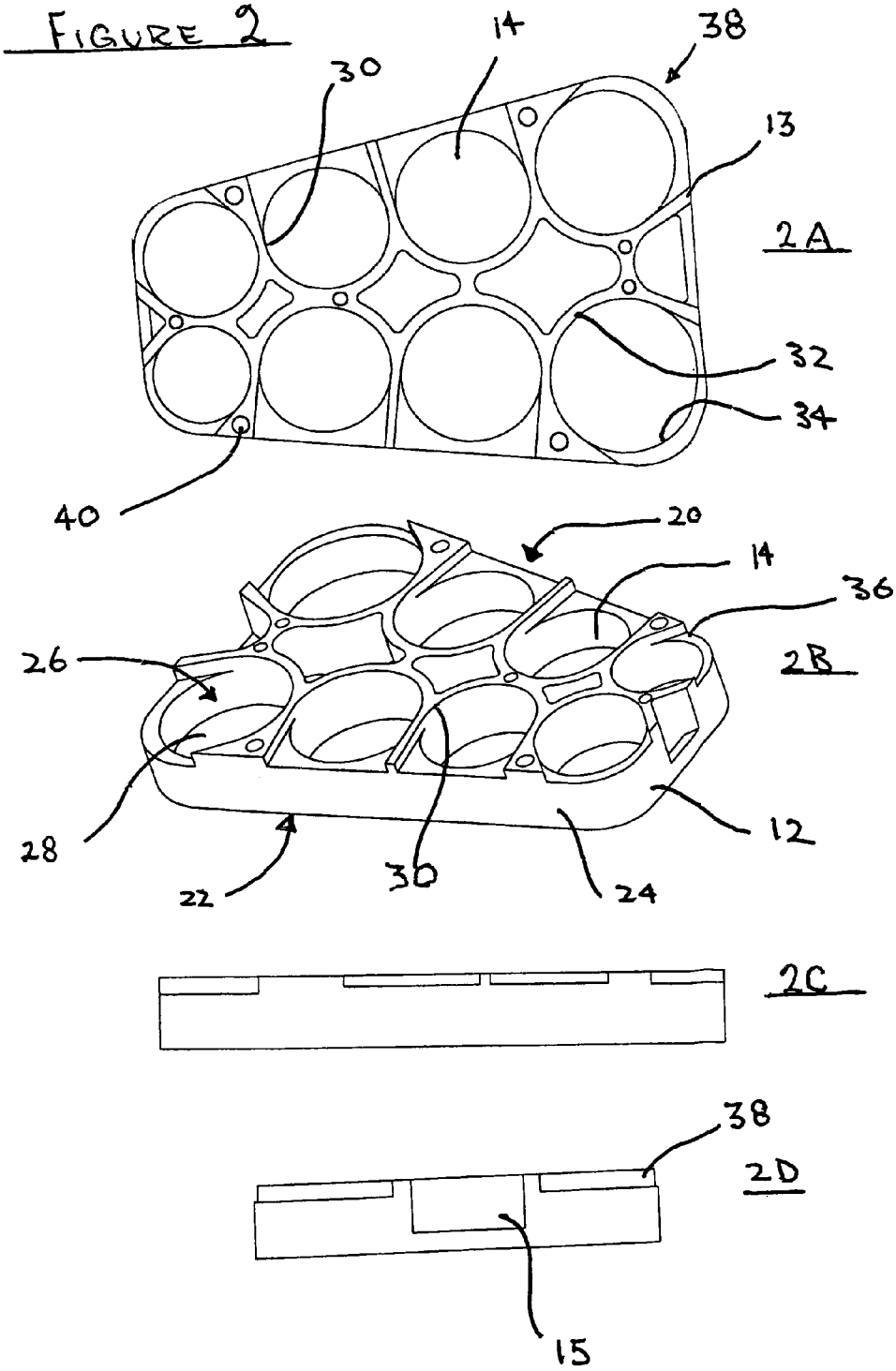
FIG. 2 illustrates views of the base of the invention.

Referring to FIG. 2, there is shown a top view (2A), a perspective top view (2B), a side view (2C) and an end view (2D). Lower housing (12) has a substantially open top surface (20) and a closed bottom surface (22). The sides (24) of the lower housing are substantially vertical. In this embodiment of my invention the lower housing is a single piece molded from suitably resilient lightweight thermoplastic material. However, other materials can be used such as lightweight metals like aluminium and lightweight composite materials. The lower housing (12) further comprises a plurality of linearly spaced circular wells (14). The wells are adapted to hold a predetermined number of coins. Each circular well has a diameter slightly larger than the coin it is destined to hold to permit easy charging and dispensing of the coin to and from the coin well. Each well (14) has an open top surface (26) and a closed bottom surface (28). The top rim (30) of each well comprises an inner circumference (32) and an outer circumference (34). The outer circumference (34) of each well is cut down (36) and adapted to permit coins to be easily charged and dispensed to and from each circular well through a laterally oriented mouth (38). The inside portion of the rim (32) of the circular wells, that is, the portion that has not been cut down, forms a vertical spacer (13) between the upper plate (16) and the lower housing (12) so that when the upper plate is fixed to the lower housing the vertical spacer is in contact with the bottom surface of the upper plate and the bottom surface of the upper place and the cut down portion of the circumference of the circular well act together to form a lateral mouth (38) through which coins may be loaded into each circular well or discharged. Also shown are cylindrical receptacles (40) for cooperatively receiving projections located on the bottom surface of the top plate for fixing the top plate to the bottom housing. The cylindrical receptacles do not pierce the bottom surface of the lower housing (12). In one embodiment of the invention the lower housing is manufactured from a translucent thermoplastic material sufficiently translucent to permit the coins to be viewed from the bottom to ascertain their denomination and from the side to ascertain the number of coins or tokens contained in each well.

Still referring to FIG. 2, larger denomination coins are placed within wells adapted to receive them at the wider end of the invention and small denomination coins are placed within wells adapted to receive them at the opposite end of the invention. In one preferred embodiment of the invention two wells are placed adjacent to each other so that one of the wells houses a coin of a slightly smaller size. In another embodiment of the invention adjacent wells are identical in size.

Figure 3:
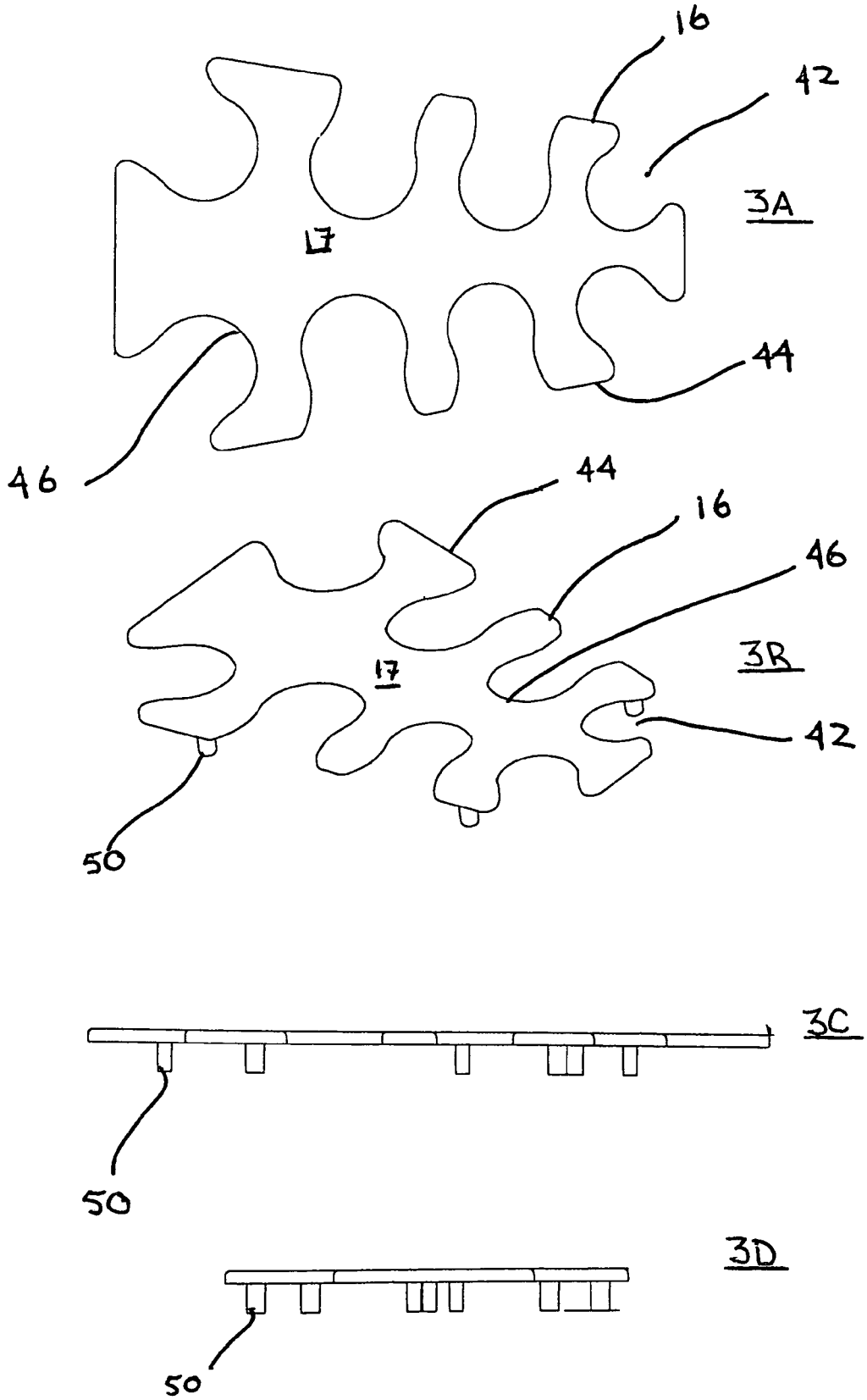
FIG. 3 illustrates views of the top plate of the invention.

Referring to FIG. 3 there is shown a top view (3A), a perspective view (3B), a side view (3C) and an end view (3D) of the upper plate (16) of one embodiment of my invention. The upper plate comprises a single piece of suitable thermoplastic material having a tapered outline conforming to the tapered outline of the lower housing so that when the upper plate is mounted to the lower housing they are contiguous and there is no overlap of the upper plate. The upper plate further comprises a plurality of linearly spaced slots (42) extending outwards from the centre portion (17) of the upper plate to the outside edge (44) of the upper plate. As shown, the outward end (44) of each slot is an open straight edge and the inward end (46) of each slot is curved and closed. In this embodiment there are eight (8) vertical projections (50) extending downward from the bottom surface of upper plate (16). These eight projections are adapted to cooperatively mate with eight cylindrical receptacles (40) located in the bottom housing as illustrated in embodiment shown in FIG. 2.

Figure 4:
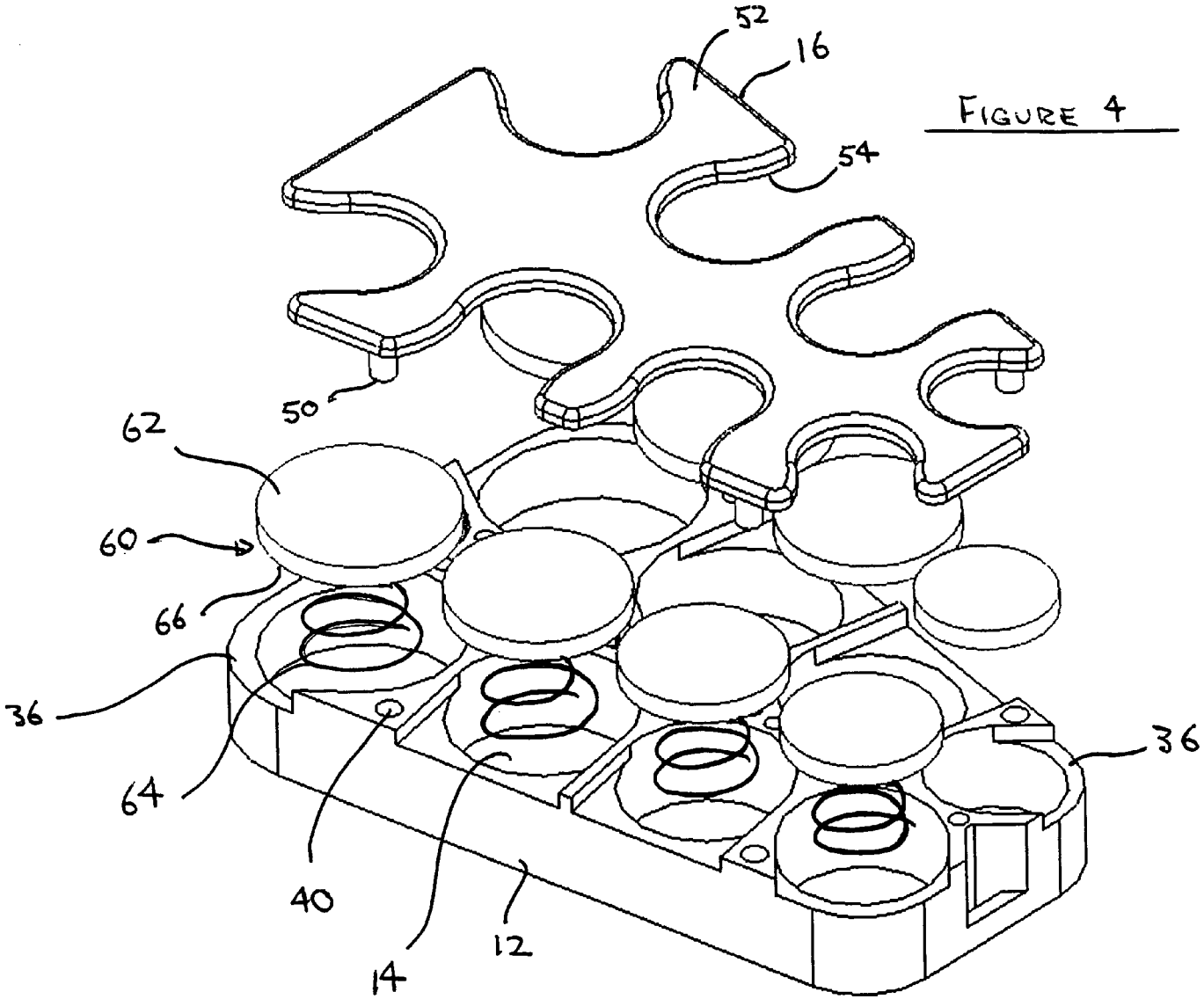
FIG. 4 illustrates assembly of the invention.

Referring to FIG. 4, an assembly drawing is shown. Upper plate (16) comprises an upper surface (52) and a lower surface (54). Depending vertically downwards from the lower surface (54) of the upper plate (16) are a plurality of cylindrical members (50) or pins. In the embodiment shown there are eight (8) such pins corresponding in a mating relationship to eight (8) receptacles (40) in the base (12). There may be more or less pins and receptacles depending on the size of the invention being made. The length of the pins (50) does not exceed the depth of the receptacles (40). The projections are adapted to fit cooperatively into the receptacles in a press-fit frictional engagement so that the upper surface of the rim of the receptacle is in contact with the lower surface of the flat plate. In another embodiment of my invention a suitable adhesive material may be used to further bind the upper plate to the lower housing. In another embodiment of my invention, the upper plate and lower housing are thermally fused together without the need for projections or receptacles.

Still referring to FIG. 4 there is illustrated means for selectively holding and dispensing coins contained within the circular wells (14) of the lower housing. There is shown a dispenser (60) comprising a circular base element (62) and biasing element (64). The dispenser (60) is inserted into each circular well (14) of the lower housing (12) prior to mounting the flat plate (16) to the top of the lower housing. Biasing element (64) is shown in this embodiment as a resilient coil spring made from a suitable deformable and elastic material. Hence the spring may be metallic or constructed from a suitable plastic material. When the coin well (14) is empty and the dispenser (60) is not loaded with coins or tokens, the top surface of the base element (62) will be in biased contact with the bottom surface (54) of the upper plate (16). Dispenser (60), comprising biasing element (64) and base element (62), is installed in well (14) so that when top plate (16) is placed over the base element (12), the biasing element is slightly compressed within well (14) and the bottom surface (66) of the base element sits slightly below the outer rim (36). In this way the bottom surface of the base element remains inside the well (14) when the well is empty of coins. No adhesion is necessary between the bottom of the base element (62) and the top neither of the biasing element nor between the bottom of the biasing element and the bottom of the coin well in which it is sitting.

The base element of the dispenser is adapted to fit closely to the walls of the coin well while permitting unhindered up and down movement of the base element in the well. The rim of the base element is preferably rounded to permit easy loading and discharging of coins.

In operation, a plurality of coins will be loaded into each well of the lower housing. The biasing element will be compressed in the coin well. The upper surface of the top coin in the well will be in frictional contact with a portion of the bottom surface of the upper plate. A portion of the top surface of the top coin will be exposed through the slot. The bottom surface of the bottom coin will be in frictional contact with the top surface of the base element. The biasing element will bias the top of the top coin against the bottom surface of the upper plate. The combined action of the frictional engagement of the top of the coin with the bottom of the upper plate and the biasing action of the biasing element will exert sufficient force to prevent the coin from dropping out of the coin well by virtue of gravity or the jostling movement that the invention will encounter in someone's pocket or purse. To discharge a coin from the invention, a person need only to swipe a thumb or finger across the exposed upper surface of the coin towards the open end of the slot. This will exert sufficient force to overcome the friction between the coin and the upper plate and move the coin outwards. The cut down outer rim of the coin well, the outward curve of the open end of the slot, and the biasing force of the biasing element act together to facilitate smooth movement of the coin and avoid jamming of the coin in the slot. To insert a coin into a coin well, a person need only depress the top coin within a particular well and insert the coin into the mouth of the well.

Although the description above contains many specifications, these should not be construed as limiting the scope of the invention but as merely providing illustrations of some of the presently preferred embodiments of this invention. Thus the scope of the invention should be determined by the appended claims and their legal equivalents rather than by the examples given.

What is claimed is:

1. A palm-held pocket-sized apparatus for organizing, holding and dispensing large and small coins and tokens, wherein said apparatus comprises:

a. an elongated lower housing having a substantially open surface, a closed flat bottom, a wide end having a first width, a narrow end having a second width, vertical sides and a length wherein said length is at least twice said second width so that said wide end corresponds to the wide end of said palm, said narrow end corresponds to the narrow end of the palm and the length is substantially equal to the width of the palm, wherein said elongated lower housing is molded from translucent thermoplastic materials to permit visual identification of said large and small coins and tokens held therein; and further wherein said closed flat bottom is adapted to receive advertising material;

b. a "U" shaped notch at said wide end of the elongated lower housing and integral thereto and a "V" shaped notch at said narrow end of the elongated narrow housing and integral thereto, wherein said "U" shaped notch and said "V" shaped notch are adapted to receive a key holder;

c. a plurality of wells disposed in identical pairs along the length of the elongated lower housing, said plurality of wells adapted to store the large and small coins and tokens, wherein the plurality of wells is advantageously arranged so that the large sized coins and tokens are at the wide end and the small sized coins and tokens are at the narrow end so that a visually impaired person can locate and distinguish between the location of the large and small coins and tokens by touch alone;

d. an elongated flat top plate fixed over the elongated lower housing open surface in an aligned relationship, said elongated flat top plate having an upper surface and a lower surface, whereby the large and small coins and tokens are retained within the plurality of wells by said lower surface, and further wherein the large and small coins and tokens are urged into frictional contact with the lower surface by biasing means disposed within each well of the plurality of wells; and wherein said upper surface of said elongated flat top plate is adapted to receive advertising material;

e. brail means integral to the upper surface of the elongated flat top plate and adjacent to each well of the plurality of wells so that the large and small coins and tokens contained in each well of the plurality of wells are identifiable to said visually impaired person by touching said brail means; and, f. fixing means for fixing the elongated flat top plate over the elongated lower housing open surface, said fixing means comprising a plurality of cylindrical pins depending vertically downward from the lower surface of the elongated flat top plate and an equal number of pin receiving receptacles located in the top surface of the elongated lower housing, wherein said plurality of cylindrical pins are in cooperative alignment with said equal number of pin receiving receptacles, and wherein the plurality of pins and the equal number of pin receiving receptacles are adapted to couple in a secure press-fit relationship so that the lower surface of the elongated flat top plate is firmly retained in contact with the open surface of the elongated lower housing.

* * * * *